US006378341B1

(12) United States Patent
Wiemer et al.

(10) Patent No.: US 6,378,341 B1
(45) Date of Patent: Apr. 30, 2002

(54) AUTOMATICALLY CONTROLLED WASHING MACHINE WITH A LYE ROLLING SYSTEM

(75) Inventors: Horst Wiemer, Kleinmachow; Harald Moschütz, Grossbeeren; Edwin Bolduan, Berlin, all of (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 09/530,842

(22) PCT Filed: Nov. 4, 1998

(86) PCT No.: PCT/EP98/07064

§ 371 Date: Jul. 21, 2000

§ 102(e) Date: Jul. 21, 2000

(87) PCT Pub. No.: WO99/23292

PCT Pub. Date: May 14, 1999

(30) Foreign Application Priority Data

Nov. 4, 1997 (DE) ..... 197 48 706

(51) Int. Cl.[7] ..... D06F 33/02; D06F 39/08

(52) U.S. Cl. ..... 68/12.02; 68/12.19; 68/58; 68/207

(58) Field of Search ..... 68/12.02, 12.05, 68/12.21, 58, 207, 12.19

(56) References Cited

U.S. PATENT DOCUMENTS 5,313,964 A * 5/1994 Dausch et al. ..... 68/207 X

FOREIGN PATENT DOCUMENTS

| | | | |
|---|---|---|---|
| DE | 4332225 | * 12/1994 | |
| FR | 1358324 | * 7/1964 | |
| JP | 211491 | * 11/1984 | ..... 68/207 |

* cited by examiner

*Primary Examiner*—Philip Coe
(74) *Attorney, Agent, or Firm*—Herbert L. Lerner; Laurence A. Greenberg; Werner H. Stemer

(57) ABSTRACT

Detergent solution is discharged by means of a pump (10) at the bottom of a washing handling space (1) and is fed back to the handling space (1) via a pipeline (9) above the washing (3) located in the handling space. The washing machine is also connected to a fresh-water supply line (5) which can be opened and closed by a valve (7) which is controllable by a sensor device (12) suitable for establishing a volumetric flow present in the pumping direction of the pump (10).

It is possible to dispense with a separate sensor element for controlling the fresh-water supply by a body (13) which can be actuated by the volumetric flow prevailing in the pipeline (9) being arranged along the pipeline (9) and, depending on the presence or absence of volumetric flow, protruding into or releasing the measuring section (18) of a turbidity sensor (17). Finally, the valve (7) is controlled by the turbidity sensor (17) so as to assume its opening or closed position.

6 Claims, 1 Drawing Sheet

AUTOMATICALLY CONTROLLED WASHING MACHINE WITH A LYE ROLLING SYSTEM

BACKGROUND OF THE INVENTION

Field of the Invention

The invention relates to an automatically controlled washing machine with a detergent-solution circulating system in which detergent solution is discharged by means of a pump at the bottom of a washing handling space and is fed back to the handling space via a pipeline above the washing located in the handling space, which washing machine is also connected to a fresh-water supply line which can be opened and closed by a valve which is controllable by a sensor device suitable for establishing a volumetric flow present in the pumping direction of the pump.

Such a washing machine is known from DE-A-43 32 225. In the case of this washing machine, a detergent-solution circulating system is connected at the bottom of the tub in order for washing-detergent or rinsing solution to be constantly flowing through the washing located in the washing drum. This circulating system comprises a pipeline, along which a detergent-solution pump and a sensor device are arranged. The presence of a flow in the pipeline is sensed by the sensor device. Depending on the presence or absence of a flow in the pipeline, the sensor device emits a corresponding signal to the valve arranged along the fresh-water supply line, whereby the fresh-water supply is either introduced or shut off. In this way, the washing machine is constantly supplied only with the amount of water absolutely necessary.

SUMMARY OF THE INVENTION

The invention is based on the object of developing a washing machine of the type described at the beginning in such a way that the control of the fresh-water supply can take place as far as possible with sensor elements that are already on the washing machine in any case.

The set object is achieved according to the invention by a body which can be actuated by the volumetric flow prevailing in the pipeline being arranged along the pipeline and, depending on the presence or absence of volumetric flow, protruding into or releasing the measuring section of a turbidity sensor, by which turbidity sensor the valve is controlled so as to assume its opening or closed position. Consequently, just a simple mechanical part need be installed in the pipeline, whereas the turbidity sensor present in any case for measuring the turbidity of the rinsing water is used for the more complex sensing task.

According to a further refinement of the invention, the body is designed as a float and is arranged in a vertically extending region of the pipeline. In the case of such an arrangement, the float assumes its position of rest of its own accord, on account of gravity. consequently, no separate means are required for returning the float to its position of rest.

As a result of the fact that the float is design ed in the manner of a valve disk provided with a stem, the stem protruding into the measuring section of the turbidity sensor when the float is in the position of rest and the valve disk bearing against a valve seat, the pipeline is completely shut off when the float is in the position of rest. Consequently, the occurrence of even a very small volumetric flow already leads to the float being adjusted. This makes the device very sensitive.

A separate valve seat in the pipeline can be avoided by the circumferential rim of the valve disk having a conically flared profile and the pipeline being in the same way of a conical design, at least in the region of the position of rest of the float.

In the pipeline there is expediently also provided a stop which limits the adjusting path of the float and the position of which is chosen such that when the float is bearing against the stop the stem completely releases the measuring section of the turbidity sensor.

BRIEF DESCRIPTION OF THE DRAWINGS

The invention is explained below on the basis of an exemplary embodiment represented in the drawing, in which.

DESCRIPTION OF THE PREFERRED EMBODIMENTS

Figure 1:
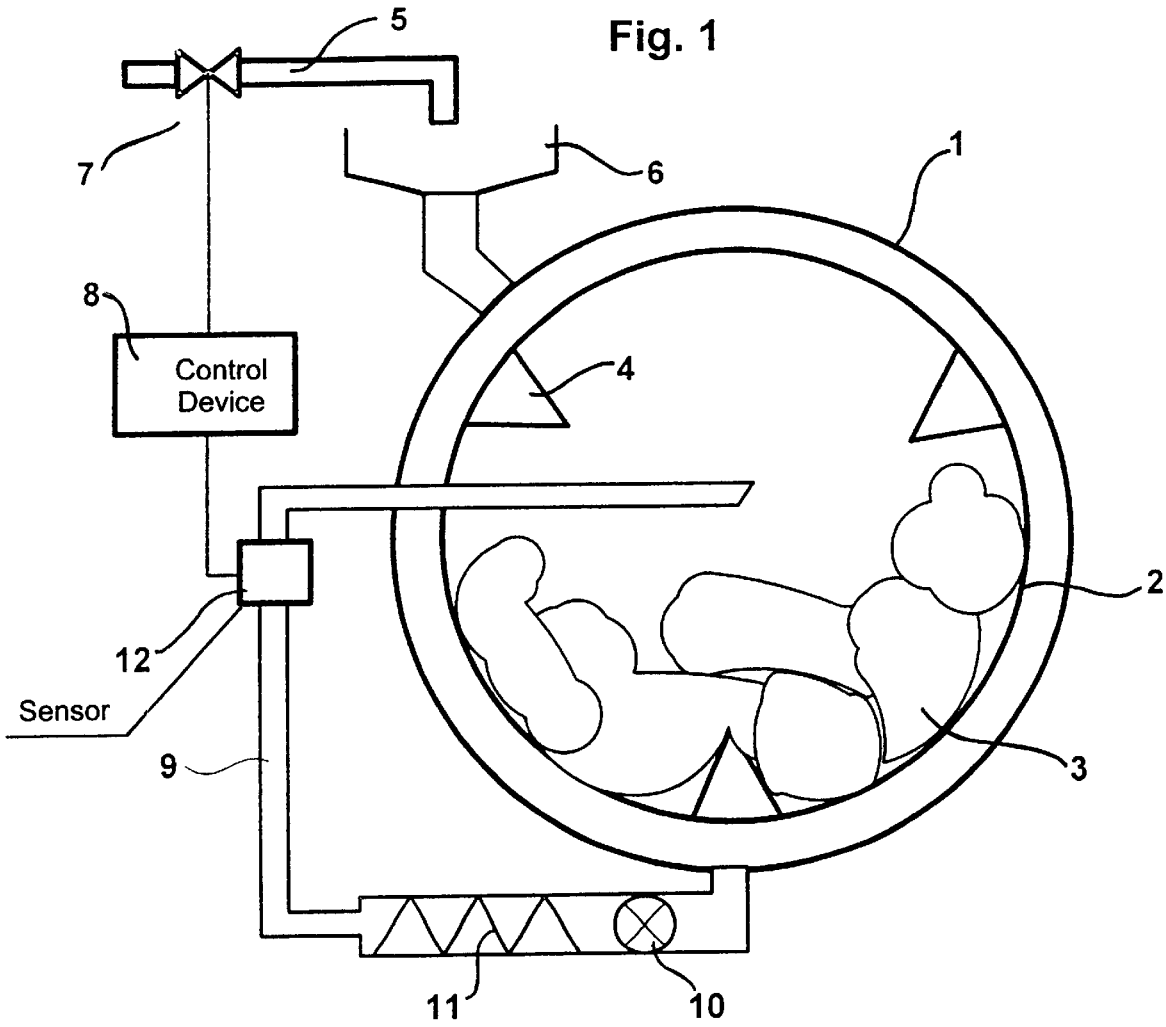
FIG. 1 shows an automatically controlled washing machine in a schematic representation.

A washing drum 2 is rotatably mounted in the tub 1 of the washing machine. Lying in said washing drum are items of washing 3, which are lifted and dropped again by paddles 4 during rotation of the drum 2. As a result, a constant rearrangement of the layers of washing items takes place, as a result of which they are constantly flowed through in new directions by washing-detergent or rinsing solution. The washing-detergent or rinsing solution is introduced into the tub 1 via a fresh-water supply line 5 and a detergent container 6. A valve 7 in the fresh-water supply line 5 serve s for controlling the fresh-water supply. For this purpose, the valve 7 is controlled by a control device 8 of the washing machine.

For washing-detergent or rinsing solution to be constantly flowing through the washing, a detergent-solution circulating system is connected at the bottom of the tub 1. This system comprises a pipeline 9, along which a detergent solution pump 10, a heating device 11 and a sensor device 12 are arranged.

Figure 2:
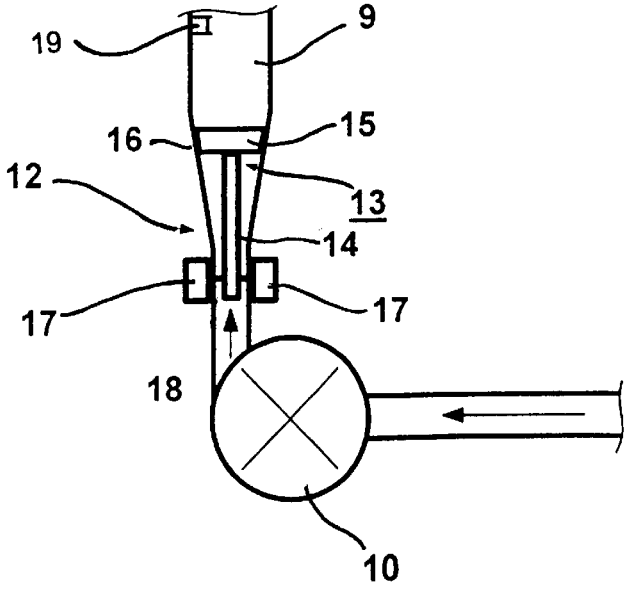
FIG. 2 shows the design of a sensor device using a turbidity sensor.

According to the design variant shown in FIG. 2, the sensor device 12 has a float 13 arranged in the pipeline 9. The float 13 is designed like a valve disk 15 provided with a stem 14. The circumferential rim 16 of the valve disk 15 is of a conically flared design. The pipeline 9 is in the same way of a conically flared design, at least in the region corresponding to the position of rest of the float 13. Consequently, in the position of rest, i.e. where there is no volumetric flow, in the pipeline 9, the valve disk 15 can come to bear with its circumferential rim 16 snugly against the inside wall of the pipeline 9.

In the pipeline 9 there is expediently also provided a stop 19, which is schematically shown in FIG. 2. The stop 19 limits the adjusting path of the float 13. The position of the stop 19 is chosen such that, when the float 13 bears against the stop 19, the stem 14 completely releases the measuring section of the turbidity sensor 17.

Fitted to the outer circumference of the pipeline 9 is a turbidity sensor 17. At least in this region, the pipeline 9 consists of translucent material, so that a light beam 18 transmitted by the transmitting part of the turbidity sensor 17 and representing the measuring section of the turbidity sensor 17 can pass through the pipeline 9 to the receiving part of the turbidity sensor 17.

The diameter of the valve disk 15 is made to match the inside diameter of the pipeline 9 in such a way that the valve disk 15 comes to bear against the inside wall of the pipeline 9 with respect to the position of the measuring section of the turbidity sensor 17 such that its stem 14 still protrudes into the light beam 18 of the turbidity sensor 17 and interrupts the latter. As a result, a corresponding control signal can be emitted by the turbidity sensor 17 to the control device 8, by which the valve 7 is made to open by the control device 8. Consequently, freshwater is supplied until the pump 10 can pump water into the pipeline 9.

The volumetric flow ensuing in the pipeline 9 lifts the valve disk 15 and, as a result, draws the stem 14 out of the measuring section, i.e. out of the light beam 18. The light beam 18 then impinges on the receiving part of the turbidity sensor 17 and triggers a control signal, by which the valve 7 is shut off again. Consequently, the washing machine is supplied only with the amount of water absolutely necessary for a washing cycle.

The turbidity sensor 17 present in any case in modern washing machines is thus used not only for measuring turbidity during the rinsing cycle of the washing machine but also for controlling the fresh-water supply. It is consequently possible to dispense with a separate sensor element for controlling the fresh-water supply.

What is claimed is:

1. An automatically controlled washing machine, comprising:

a laundry handling chamber having a bottom region and an upper region disposed above said bottom region;

a pipeline for feeding a detergent solution into said upper region of said laundry handling chamber;

a detergent-solution circulating system having a pump connected to said pipeline for generating a volumetric flow through said pipeline;

said pump having a pumping direction for pumping the detergent solution from said bottom region of said laundry handling chamber and for feeding the detergent solution to said upper region of said laundry handling chamber via said pipeline;

a fresh water supply line;

a valve connected to said fresh water supply line and having an open position and a closed position;

a sensor device connected to said pipeline for sensing the volumetric flow through said pipeline;

said sensor device having a turbidity sensor with a measuring section;

said sensor device having a body actuated by the volumetric flow prevailing in said pipeline;

said body protruding into the measuring section and clearing the measuring section depending on one of a presence and an absence the volumetric flow; and said turbidity sensor controlling said valve to be in one of the open position and the closed position.

2. The washing machine according to claim 1, wherein:

said body is a floating body;

said pipeline has a vertically extending section; and said floating body is provided in said vertically extending section of said pipeline.

3. The washing machine according to claim 2, wherein:

said floating body has a valve disk and a stem connected to said valve disk;

a valve seat is provided for cooperating with said valve disk;

said stem protrudes into the measuring section of said turbidity sensor and said valve disk bears against said valve seat when said floating body is in a resting position.

4. The washing machine according to claim 3, wherein:

said floating body has a floating path;

a stop device is disposed in said pipeline for limiting the floating path of said the floating body; and said stem completely clears the measuring section when said floating body bears against said stop device.

5. The washing machine according to claim 2, wherein:

said floating body has a valve disk and a stem connected to said valve disk;

said valve disk has a circumferential rim with a conically flared profile;

said pipeline has a conical region for cooperating with said circumferential rim; and said stem protrudes into the measuring section of said turbidity sensor and said circumferential rim bears against said conical region of said pipeline when said floating body is in a resting position.

6. The washing machine according to claim 5, wherein:

said floating body has a floating path;

a stop device is disposed in said pipeline for limiting the floating path of said the floating body; and said stem completely clears the measuring section when said floating body bears against said stop device.

* * * * *